US005829642A

United States Patent [19]

Momboisse

[11] Patent Number: 5,829,642

[45] Date of Patent: Nov. 3, 1998

[54] DISPLAY FOR TESTING SPRAY COSMETICS

[75] Inventor: Philippe Momboisse, Richebourg, France

[73] Assignee: RLB S.A., La Bussiere, France

[21] Appl. No.: 714,132

[22] PCT Filed: Mar. 16, 1995

[86] PCT No.: PCT/FR95/00319

§ 371 Date: Nov. 12, 1996

§ 102(e) Date: Nov. 12, 1996

[87] PCT Pub. No.: WO95/24971

PCT Pub. Date: Sep. 21, 1995

[30] Foreign Application Priority Data

Mar. 16, 1994 [FR] France ..... 94 03097

[51] Int. Cl.[6] ..... B67D 5/64

[52] U.S. Cl. ..... 222/162; 222/180

[58] Field of Search ..... 222/162, 180, 222/183, 154, 325, 529, 130, 509, 383.1

[56] References Cited

U.S. PATENT DOCUMENTS 3,516,424 6/1970 Eagle ..... 222/162

4,394,934 7/1983 Fegley ..... 222/162

5,347,998 9/1994 Hodson et al. ..... 222/162

*Primary Examiner*—Philippe Derakshani

*Attorney, Agent, or Firm*—Young & Thompson

[57] ABSTRACT

A tester for a cosmetic such as perfume or eau de toilette to be sprayed from a bottle (2) provided with a pressure-operated spray valve (3). The tester includes a holder (4) supporting bottles carriers (13, 29, 30); an assembly (16) for dispensing the product to be tested, including a dispensing tube (17) with a dispensing opening (20) at one end and a connector (21) releasably attached to the valve (3) at the other end; a manual control assembly (23) actuated when a user's hand is placed in the region of a suitably identified portion (24) of the holder (4); and an actuating assembly (25) controlled by the control assembly (23) to depress the spray valve (3). The dispensing assembly (16) is spaced apart from the actuating portion (24) so that the dispensing opening (20) is aimed at the user's hand when the control assembly (23) is actuated.

28 Claims, 2 Drawing Sheets

DISPLAY FOR TESTING SPRAY COSMETICS

The invention relates to a tester and to a tester assembly for spray cosmetics, such as perfume or toilet water ("eau de toilette") for spraying from a bottle provided with a depressible spray valve.

BACKGROUND OF THE INVENTION

Until now, perfume or toilet water has been tried out by a purchaser or a user at a point-of-sale or of presentation in one of the two following manners: either the bottle containing the cosmetic in question is handled directly and the valve actuated; or else the spray cosmetic is decanted into a flask forming part of a spray fountain including a drive member.

The first case suffers from the risk of the bottle that is being used for test purposes being stolen and also from lack of practicality. The drawback of the second case is that it requires a large amount of handling and it does not enable the cosmetic to be sprayed in an appropriate zone, e.g. on the back of the user's hand near the wrist.

In both cases, it is observed that in general too much cosmetic is sprayed and a large portion of the sprayed cosmetic is released into the atmosphere which is undesirable for numerous reasons. Finally, in both cases, the trial is unattractive for the purchaser or user.

Document U.S. Pat. No. 4,838,456 discloses a dispenser device for spraying a cosmetic onto the hands of a user. That device comprises a housing having a plurality of walls forming a chamber for the hands and having an opening through which the hands are inserted into the chamber.

The device also includes an L-shaped trigger element having a horizontal arm supported by a pivot, a disk portion disposed in the chamber to come into contact with the hands, and a vertical arm disposed outside the housing. A resilient bracket is fixed to a wall of the housing and includes a cavity for receiving a portion of an aerosol button, and also an orifice through which sprayed cosmetic can pass.

Thus, an upwardly directed force applied to a portion of the disk gives rise to a downwardly directed force on the bracket for actuating the aerosol and to cosmetic being sprayed into said chamber. Nevertheless, that device does not enable the cosmetic to be sprayed effectively on a precise zone of the hand. Also, it is not usable with a bottle.

The state of the art is generally shown by the following documents: U.S. Pat. No. 3,987,935, FB-A-946018, GB-A-906837, and EP-A-567678.

OBJECTS AND SUMMARY OF THE INVENTION

The invention seeks to remedy the above-mentioned drawbacks, and to this end it provides a tester for a spray cosmetic such as perfume or toilet water in a bottle provided with a depressible spray valve, the tester comprising: a support and, carried thereby, holding means for holding a bottle; dispenser means for dispensing the cosmetic to be sprayed and comprising a dispenser tube terminated at one end by a dispenser opening and at its other end by an endpiece designed to be removably mounted on the valve; manual control means actuated by the presence of a user's hand when the hand is placed close to a zone of the support identified for that purpose; and drive means controlled by the control means and suitable for pressing the spray valve of the bottle; the dispenser means being at a distance from the control means so that the dispenser opening faces the hand of the user actuating the control means.

According to other characteristics of the invention, the holding means are in the form of a case.

The dispenser tube comprises two contiguous lengths, namely a fixed and rigid length adjacent to the dispenser opening and a deformable and movable length adjacent to the endpiece.

The support includes a panel on the back face of which there is the case, a base plate placed at the end of the panel close to the control zone.

The support also includes a bracket fixed to the support panel adjacent to the dispenser means and capable of serving as a stand for a second bottle of cosmetic to enable the cosmetic to be identified by the user.

The dispenser means are organized to enable the cosmetic to be sprayed or to be dispensed in drops.

The control means are operated either by mechanical contact such as by a lever, a handle, a knob, or a slider in particular, or without contact by proximity detection.

The drive means comprise a member acting mechanically on the bottle proper, a member acting on the spray valve, and means suitable for establishing relative displacement between the two members over a certain stroke. The relative displacement may be in sliding or in rotation. Where appropriate, means may be provided for adjusting said stroke.

In a possible embodiment, the control means are in the form of a pedal mounted on the support so as to be capable of pivoting through a certain stroke. The pedal has a front portion projecting from the front face of the support panel. It passes through a slot formed in said panel and opening out towards the back face of said panel inside the case. The pedal is extended inside the case by a wall. Overall it forms a lever. The wall extending the pedal constitutes a portion of the drive means. It comes against the bottom of the bottle whose valve is engaged against a portion of the wall of the case.

The tester assembly comprises a tester as described above in association with a bottle of substance to be sprayed, the valve thereof being mounted on the endpiece of the tester, said bottle being housed in the case.

BRIEF DESCRIPTION OF THE DRAWINGS

Other characteristics of the invention appear from the following description given with reference to the accompanying drawings, in which.

MORE DETAILED DESCRIPTION

Figure 1:
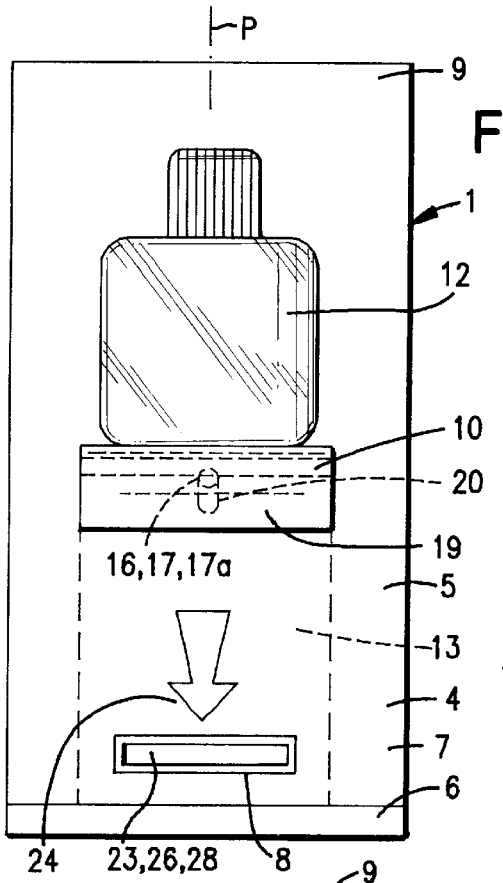
FIG. 1 is a front elevation view of the tester assembly of the invention in one particular embodiment.

The invention relates to a tester 1 for a spray cosmetic such as perfume or toilet water contained in a bottle 2 provided with a depressible spray valve 3.

As explained below, the tester is capable both of spraying the cosmetic and of dispensing it drop by drop. The description is generally given in terms of spraying.

The bottle 2 and its valve 3 do not directly constitute the subject matter of the invention. The bottle 2 is a bottle for containing the cosmetic for presentation and sales purposes. Consequently, the invention makes it possible to avoid the need to decant the cosmetic.

By way of convention, the term "tester" 1 is used to designate the device of the invention without a cosmetic bottle, while the term "tester assembly" is used to designate the tester 1 in association with the bottle 2.

The tester 1 comprises firstly a support 4. The various means, parts, and members of the tester 1 are carried by the support 4.

In the embodiment shown in FIGS. 1 to 4, the support 4 comprises a panel 5 that is designed to be placed vertically or substantially vertically in its normal position of use. The panel 5 has a front face 5*a* and a back face 5*b*.

The panel 5 is carried by and fixed to a base plate 6 located at the bottom end 7 of the panel 5. In the normal position of use, the base plate 6 is designed to be placed horizontally or substantially horizontally.

In the embodiment shown, the panel 5 is in the form of a plane plate of rectangular outline, and it is solid with the exception of slots 8 that are described in greater detail below. In other possible embodiments, the panel 5 may be curved and perforated to a greater or lesser extent, it may possibly be completely or partially transparent, and its outline may be other than rectangular.

Where appropriate, the top portion 9 of the panel 5 remote from the base plate 6 can receive trademarks or information or advertising, said portion 9 emerging above the tester and forming its top portion.

Figure 2:
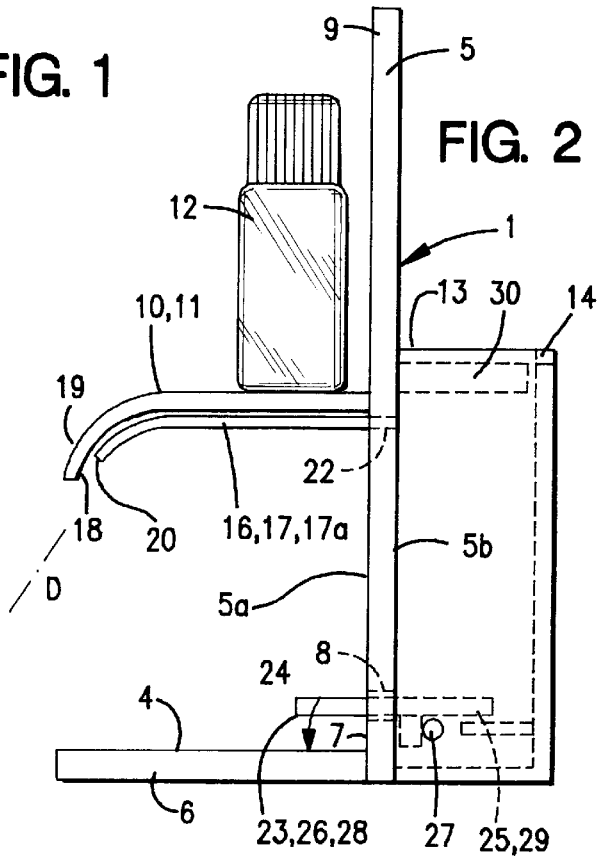
FIG. 2 is a side view of the FIG. 1 tester assembly, the bottle of substance to be sprayed being removed, as are the deformable length and the endpiece of the dispenser means.
Figure 3:
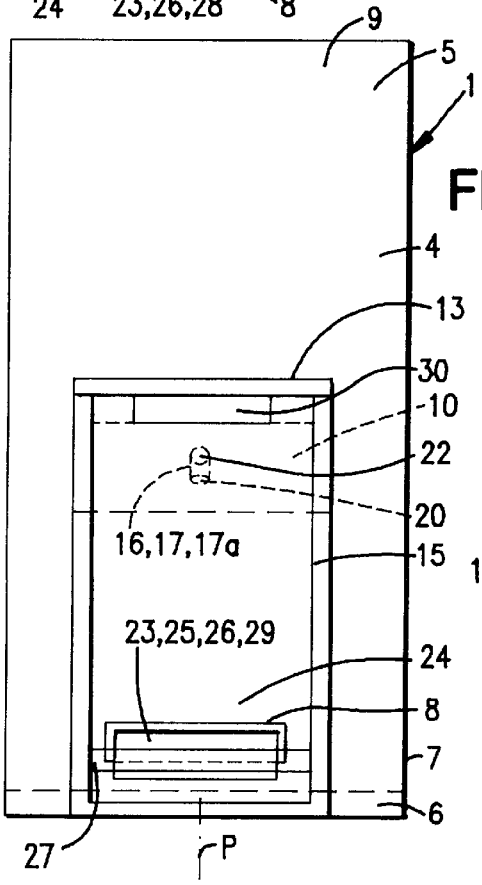
FIG. 3 is an elevation view from behind of the tester assembly without a bottle.
Figure 4:
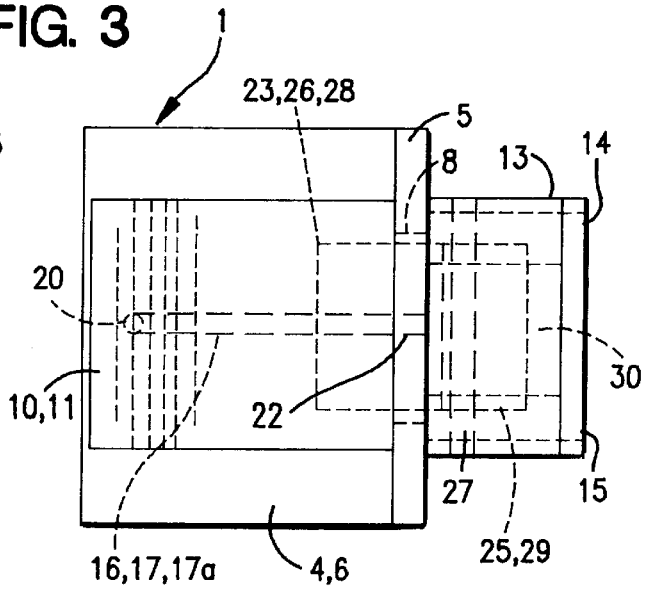
FIG. 4 is a plan view of the FIG. 3 tester assembly.
Figure 5:
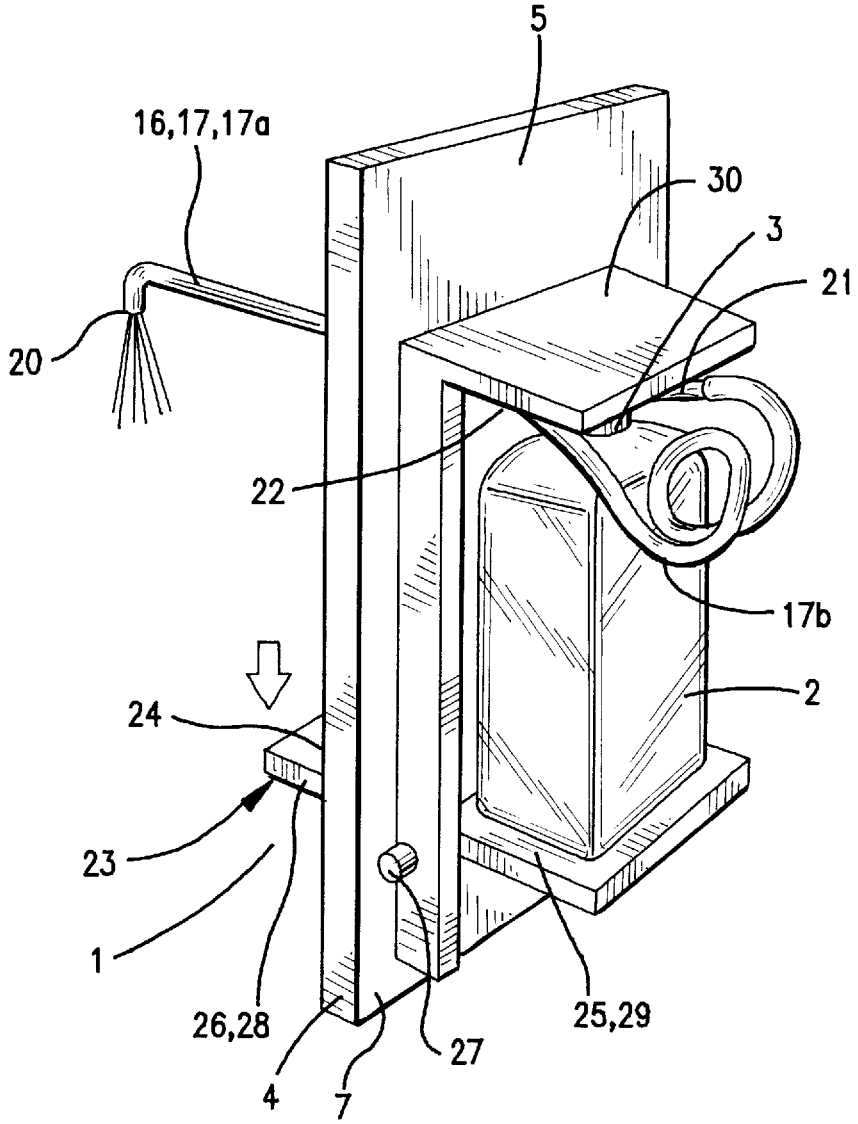
FIG. 5 is a diagrammatic perspective view of the mechanism of the assembly shown in FIGS. 1 to 4.

Such a tester therefore has a general plane of transverse symmetry P corresponding to the plane of FIG. 2.

In the embodiment shown in FIGS. 1 to 4, the support 4 also includes a bracket 10 fixed on the panel 5 and projecting from the front face 5*a* thereof. The bracket 10 is disposed substantially halfway up the panel 5 between its ends 7 and 9, and is consequently far enough away from the base plate 6 for the hand of the user to be placed between the base plate 6 and the bracket 10. The general plane of the bracket 10 is substantially parallel to the general plane of the base plate 6. In the normal position of use, the bracket 10 therefore has its main plane extending horizontally or substantially horizontally.

The top face 11 of the bracket 10 facing away from the base plate 6 can serve as a stand for a second bottle 12 of cosmetic. This second bottle is intended to display the bottle to the user and thus identify the cosmetic. The second bottle 12 is securely fixed to the bracket 10, e.g. by adhesive, or else it is merely placed thereon. Where appropriate, it may be mounted thereon in a removable manner.

The tester 1 also comprises a case 13 fixed on the back face 5*b* of the panel 5. The case 13 extends between the level of the base plate 6 and a level slightly above the bracket 10. The case 13 is preferably opaque so as to hide its contents. The case 13 has a moving or removable door 14. In the embodiment shown, the door 14 is mounted so as to slide vertically on slides 15 of the case. In this embodiment, the door 14 gives access to all of the inside of the case 13. The case 13 is intended to house the bottle 2.

The case 13 of appropriate dimensions for receiving the bottle 2 thus constitutes means for holding said bottle 2.

The tester 1 also includes dispenser means 16 for dispensing the cosmetic to be sprayed. These dispenser means comprise a dispenser tube 17 having two contiguous lengths, namely a fixed and rigid length 17*a* and a deformable and movable length 17*b*.

The fixed length 17*a* of the dispenser means 16 is adjacent to the bottom face 18 of the bracket 10 and it projects from the front face 5*a* of the panel 5 substantially perpendicularly thereto. The bracket 10 thus serves to hide the length 17*a* of the tube 17.

The bracket 10 preferably includes a front free end portion 19 that is curved towards the base plate 6 so as to ensure that the length 17*a* of the tube 17 is better hidden. At the free end of the tube 17 remote from the panel 5, and thus close to the free end portion 19, the tube 17 and more particularly its length 17*a* includes a dispenser opening 20.

The other end of the dispenser tube 17 is terminated at the free end of the deformable and movable length 17*b* by an endpiece 21 designed to be mounted on the valve 3 in removable manner.

The tube 17 passes through the wall 5 via a hole 22 provided for this purpose. This hole is hidden from the user's view, having one end immediately beneath the bracket 10 and having its other end inside the case 13.

The endpiece 21 may be implemented in various ways. The endpiece may be in the form of a length of hose suitable for connection to the valve 3, or else the button-forming portion of the valve 3 is removed and a button-forming portion of the endpiece 21 is substituted therefor, in which case the deformable length 17*b* of the tube 17 is connected directly to said button-forming portion.

The deformable and movable length 17*b* which projects from the back face 5*b* of the panel 5 can be received completely inside the case 13. This length 17*b* is long enough to allow the bottle 2 to be extracted from the case 13. For example, it is possible to place the bottle on a table or shelf close to the open case 13 while the bottle 2 is being replaced. The length 17*a* extends far enough in an appropriate direction to enable a user who has placed a hand in the appropriate location of the tester 1 to receive the cosmetic on the desired zone of the hand, in particular on the back of the hand close to the wrist. To this end, the dispenser opening 20 may be situated at a distance of about 5 cm to 15 cm from the panel 5, and in particular at a distance of about 7 cm to 8 cm.

As mentioned above, the dispenser means 16 are organized either to spray the cosmetic, or else to dispense it drop by drop. Where appropriate, means are provided to switch between those two organizations. In particular, the length of the tube 17 and its diameter and shape near the dispenser opening 20 are organized for this purpose.

When spraying, the dispenser means 16, and more particularly the end portion of the length 17*a* close to the opening 20, are organized so that the spray axis D is directed towards the base plate 6 or towards the plane of the base plate 6 while also being directed away from the panel 5. For example, the axis D may be at a angle of about 45° relative to the panel 5.

The tester also includes manual control means 23. These means 23 are actuated by the presence of user's hand when placed close to a zone 24 of the support 4 that is identified for this purpose.

Drive means 25 are also provided under the control of the control means 23 and suitable for pressing the spray valve 3 (or the endpiece 21).

The control zone 24 is identified by means of a written instruction such as "press" or "turn", or by an appropriate pictogram. This zone 24 is situated on the panel 5 close to the base plate 6. Consequently, the dispenser means 16 are remote from the control zone 24 so that the dispenser opening 20 faces the hand of the user actuating the control means 23. The dispenser opening 20 is also situated facing the base plate 6 whiles still being remote therefrom.

The base plate 6 is large enough to pick up excess sprayed cosmetic. It thus constitutes excess cosmetic receiver means.

In order to ensure that the tester and the tester assembly satisfy cleanliness requirements appropriate to this type of substance, the base plate 6 is organized so that any traces of excess sprayed cosmetic are substantially invisible.

To this end, various embodiments can be envisaged: the base plate 6 may have a surface that is smooth and curved so as to be easily cleaned. Or else the base plate 6 may have a surface with relief thereon naturally masking traces of excess sprayed cosmetic. Or indeed, the base plate 6 may include or incorporate absorption means such as a sheet of blotting paper.

The control means 23 operate either by mechanical contact, such as a lever, a handle, a knob, or a slider, in particular, or else they operate without contact by proximity detection.

In the particular embodiment shown, the control means 23 are in the form of a pedal 26 mounted on the support 4 and more particularly on the panel 5 in such a manner as to be capable of pivoting about an axis 27 situated in the case 13, and extending horizontally and perpendicularly to the plane P. The pedal 26 has a front portion 28 projecting from the front face 5*a* of the panel 5. It passes through the slot 8 formed in the panel 5. It comes out in the back face 5*b* and is extended inside the case 13 by a moving wall 29. The assembly 26, 27, 28, and 29 forms a lever. At rest, the pedal 26 extends substantially horizontally. Control consists in pressing the pedal 26 down a little, thereby moving the wall 29 upwards by pivoting about the axis 27.

The drive means 25 comprise a member acting mechanically on the bottle 2 proper (i.e. on the bottle itself, not the valve 3), a member acting mechanically on the spray valve 3 or on the endpiece 21, and finally means suitable for imparting relative displacement between the two members over a certain stroke. The relative displacement may be in sliding or in rotation.

One of the two members is fixed while the other one is moving. In the embodiment shown, the member acting on the bottle presses against the bottom thereof and it is the moving member, while the member acting on the valve 3 or the endpiece 21 is fixed, being carried by the support 4 and constituted by a wall or wall portion of the case 13, in this case the top horizontal wall 30.

In another embodiment, not shown, the member acting on the bottle 2 is carried in fixed manner by the support 4 while the members acting on the valve 3 or the endpiece 21 are carried in movable manner.

In a possible embodiment, not shown, provision is made for the drive means 25 to include means for adjusting the relative displacement stroke between the two members. These adjustment means may be in the form of knurled wheels, sliders, threaded rods, notched slides, wedges, etc.

In the embodiment of FIGS. 1 to 5, the drive means 25 thus comprise the moving wall 29 and a wall or wall portion 30 of the case 13. These two walls are placed facing each other and they are spaced apart. Thus, the moving wall 29 extending the pedal 26 of the control means 23 forms a portion of the drive means 25.

In this embodiment, the bottle 2 is thus held between the two walls 29 and 30. To limit the upwards stroke of the pedal 26, an additional wall 31 is preferably provided inside the case 13.

The above-described tester and the tester assembly operate as follows:

The endpiece 21 is initially installed on a cosmetic bottle 2. To this end, the door 14 of the case 13 is previously opened.

The bottle 2 can then be placed inside the case 13, with the length 17*b* being suitable for being received completely inside the case.

The door 14 is then closed.

The tester and the tester assembly are then ready to operate.

Since the valve 3 and the endpiece 21 project relative to the bottle 2 proper, the pedal 26 is in a position where it is high and horizontal.

The user can then move a hand towards the panel 5 and in particular towards the zone 24 containing the slot 8 and the pedal 26. Because of the instruction, the pictogram, or merely because the action comes naturally, the user actuates the control means 23, and in this case presses down the pedal 26.

This has the effect of actuating the drive means 25. Specifically, this causes the moving wall 29 to move upwards.

Since the valve 3 and the endpiece 21 are held by the wall 30 of the case 13, the moving wall 29 pressed against the bottom of the bottle 2 causes it to move vertically upwards towards the wall 30, which corresponds to the relative movement of pressing on the valve 3. As a result the cosmetic is dispensed from the bottle 2 onto the hand of the user via the endpiece 21, the lengths 17*a* and 17*b* of the tube 17, and the dispenser opening 20.

Naturally, numerous variant embodiments of the invention are possible.

I claim:

1. A tester for a spray cosmetic in a bottle provided with a depressible spray valve, the tester comprising:

a support and, carried thereby, holding means for holding the bottle;

control means actuated by the presence of a user's hand when the hand is placed close to a zone adjacent said support;

dispenser means for dispensing the cosmetic to be sprayed and comprising a dispenser tube terminated at one end by a dispenser opening and at its other end by an endpiece designed to be removably mounted on the valve, said dispenser means being spaced from said control means so that said dispenser opening faces the hand of the user actuating said control means, said dispenser tube comprising two contiguous lengths, namely a fixed and rigid length adjacent to said dispenser opening and a deformable and movable length adjacent to said endpiece; and drive means controlled by said control means and for pressing the spray valve.

2. The tester according to claim 1, wherein said holding means comprise a case to house the bottle on a back face of said support.

3. The tester according to claim 2, wherein said case comprises a door.

4. The tester according to claim 2, wherein said case is opaque.

5. The tester according to claim 2, wherein said fixed and rigid length projects from a front face of said support, and the deformable movable length projects from a back face of said support opening into said case.

6. The tester according to claim 1, wherein said support comprises a panel and a base plate at an end of said panel, said base plate facing said dispenser opening at a distance therefrom adjacent said zone.

7. The tester according to claim 6, wherein said base plate comprises receiver means for receiving excess sprayed cosmetic.

8. The tester according to claim 7, wherein said base plate includes means for ensuring that traces of excess sprayed are substantially invisible.

9. The tester according to claim 8, wherein said base plate comprises one of a smooth surface that is easily cleaned, a surface with relief for hiding traces of cosmetic, and absorption means.

10. The tester according to claim 6, wherein said support further comprises a bracket fixed to said panel and projecting therefrom, said dispenser opening being adjacent to a bottom face of said bracket, and a top face of said bracket forming a stand for a second bottle of cosmetic.

11. The tester according to claim 1, wherein said dispenser means spray the cosmetic or dispense it drop by drop.

12. The tester according to claim 6, wherein said dispenser opening has a dispensing axis directed towards said base plate and away from said panel.

13. The tester according to claim 12, wherein said dispenser axis is at an angle of about 45° relative to said panel.

14. The tester according to claim 1, wherein said control means comprises one of a lever, a handle, a knob, a slider, and a proximity detector.

15. The tester according to claim 1, wherein said control means comprise a pivoted pedal on said support, said pedal comprising a front portion projecting from a front face of said support and a rear portion projecting from a back face of said support.

16. The tester according to claim 15, wherein said rear portion is a portion of said drive means.

17. The tester according to claim 11, wherein said drive means comprise a first member for acting mechanically on the bottle, a second member for acting mechanically on the spray valve, and means for imparting relative displacement between said first and second members.

18. The tester according to claim 17, wherein said first member is movably carried by said support, said second member is fixedly carried by said support.

19. The tester according to claim 17, wherein said first member is movably carried by said support and said second member is movably carried by said support.

20. The tester according to claim 17, wherein the relative displacement between said first and second members is one of linear and arcuate.

21. The tester according to claim 17, wherein said drive means comprises adjustment means for adjusting the relative displacement between said first and second members.

22. The tester according to claim 2, wherein said drive means comprises a moving wall and a wall portion of said case, said moving wall and said wall portion facing each other and being spaced apart from each other.

23. The tester according to claim 22, wherein said wall portion acts on the spray valve, and said moving wall acts on a bottom of the bottle.

24. The tester according to claim 1, further comprising the bottle of spray cosmetic, the valve of said bottle being mounted on said endpiece.

25. The tester according to claim 24, further comprising a second bottle of cosmetic.

26. The tester according to claim 24, further comprising a case on a back face of said support, said case having a first portion against which the spray valve is pressed and a moving portion, and wherein said bottle is housed within said case and held between said first portion and said moving wall.

27. The tester according to claim 26, wherein said deformable length of the tube is long enough to extract said bottle from said case.

28. The tester according to claim 24, wherein said support comprises a panel that is substantially vertical and a base plate that is substantially horizontal.

* * * * *